US007506831B1

(12) United States Patent
Weiner

(10) Patent No.: US 7,506,831 B1
(45) Date of Patent: Mar. 24, 2009

(54) MULTIPLE YARN DELIVERY TO A SINGLE NEEDLE METHOD AND APPARATUS

(76) Inventor: Robert S. Weiner, P.O. Box 2399, Dalton, GA (US) 30722-2399

( * ) Notice: Subject to any disclaimer, the term of this patent is extended or adjusted under 35 U.S.C. 154(b) by 644 days.

(21) Appl. No.: 11/041,824

(22) Filed: Jan. 24, 2005

(51) Int. Cl.
*D02H 1/00* (2006.01)

(52) U.S. Cl. ..... 242/131; 242/157 R; 242/129.72; 242/594

(58) Field of Classification Search ..... 242/131, 242/131.1, 157 R, 129.62, 129.72, 594
See application file for complete search history.

(56) References Cited

U.S. PATENT DOCUMENTS 3,875,883 A * 4/1975 Eberwein et al. ..... 112/475.23
5,531,392 A * 7/1996 Weiner ..... 242/131
5,613,643 A * 3/1997 Weiner ..... 242/131
5,624,082 A * 4/1997 Ligon ..... 242/131
7,004,415 B2 * 2/2006 Ingram, III ..... 242/131.1
7,316,366 B2 * 1/2008 Ingram, III ..... 242/131.1

* cited by examiner

*Primary Examiner*—Emmanuel M Marcelo
(74) *Attorney, Agent, or Firm*—Stephen J. Stark; Miller & Martin PLLC

(57) ABSTRACT

A textile machine receives a plurality of yarn strands from a yarn supply. A header receives the yarn strands where multiple strands are combined for joint direction to the textile machine. Beams with multiple yarn strands wrapped thereon preferably function as the yarn supply and the header may direct through yarn tubes to a staging header for use by the textile machine. The textile machine is preferably a tufting machine and multiple yarn strands are received by at least one needle of the tufting machine.

20 Claims, 3 Drawing Sheets

PRIOR ART

PRIOR ART

MULTIPLE YARN DELIVERY TO A SINGLE NEEDLE METHOD AND APPARATUS

BACKGROUND OF THE INVENTION

This invention relates to textile machinery and its use, and more particularly to textile manufacturing machines such as a creel wherein a group of a plurality of yarn strands are received and are fed to the textile machinery.

DESCRIPTION OF RELATED ART

In textile machines, such as tufting machines, yarn is normally fed to the machinery either directly from a creel or from a warper. A creel is a frame having an array of vertical and horizontal support members including a multiplicity of yarn cone holders. A yarn cone is a spool about which yarn is wound. There are a multiplicity of yarn cone holders provided in horizontally and vertically disposed pairs, one cone holder of the pair mounting the active yarn cone and the other mounting a reserve or magazine cone used after the active cone is emptied. Each cone holder pair normally has its own yarn guide tube through which yarn on each holder of the pair may be fed. While this is the standard arrangement for creels, other creel configurations could also be utilized for tufting machines.

A warper is normally a machine having a large spool, known in the art as a beam, on which yarn is wound and which subsequently supplies the yarn to a tufting machine. These may have more than one yarn wound thereabout and even a plurality of beams may be utilized such as mini-beams as described in U.S. Pat. No. 6,592,069. However, in the prior art as known to the applicant, each yarn would be fed to a separate needle from the beam. The applicant is unaware of any use of beams to provide a plurality of yarns to a single needle.

In the art of tufting, generally a strand of yarn is fed through each needle. However, there are some occasions when it may be desired to feed a plurality of fine yarn strands to each needle for providing tufted fabrics having unique patterns. Presently, when such need arises, and in order to supply more than one yarn strand to a needle of a tufting machine, the yarn strands are cabled together onto a single yarn cone or to reserve a magazine position as used for mounting an active cone. Cabling involves winding the plural yarns onto a single yarn cone, but yarn manufacturers typically merchandise yarn cones with but a single yarn wound thereon. Thus, cabling requires unwinding the yarn cones from several cones and rewinding the yarns as a group on the multi-yarn cones. Cabling is therefore believed to be inconvenient and time consuming. Magazining, on the other hand, would appear to limit to two the number of yarn strands capable of being used and thus limits the pattern potential.

In an effort to overcome the disadvantages of the prior art, U.S. Pat. Nos. 5,531,392 and 5,613,643, incorporated by reference, are directed to providing multiple yarn strands to a single yarn guide tube. This is believed to be a huge advance over the prior art. However, the creels shown and described in these patents are not configured to be utilized with beams of yarn.

SUMMARY OF THE INVENTION

Consequently, it is a primary object of the present invention to provide a yarn supply such as a creel or at least one beam which feed a plurality of yarn strands for use by a single needle of a tufting machine or other textile machinery either directly or indirectly.

It is another object of the present invention to provide a yarn supply which provides a plurality of yarns to a single needle utilizing an eye board.

It is another object of the present invention to provide a yarn supply which feeds a plurality of yarns to a single needle apart from the methods and apparatus taught in U.S. Pat. Nos. 5,531,392 and 5,613,643.

Accordingly, the present invention provides a yarn supply for feeding yarn to a textile machine such as a tufting machine wherein a plurality of yarn ends are fed to a single needle of the textile machine. The yarn supply is preferably one of a creel and a beam. Yarn ends are directed from the yarn supply to an eye board where there is at least one eye per needle and at least two yarns directed through each of the eyes and then to each corresponding needle. The eye board may be connected to a tube bank which directs yarn toward the specific needle.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
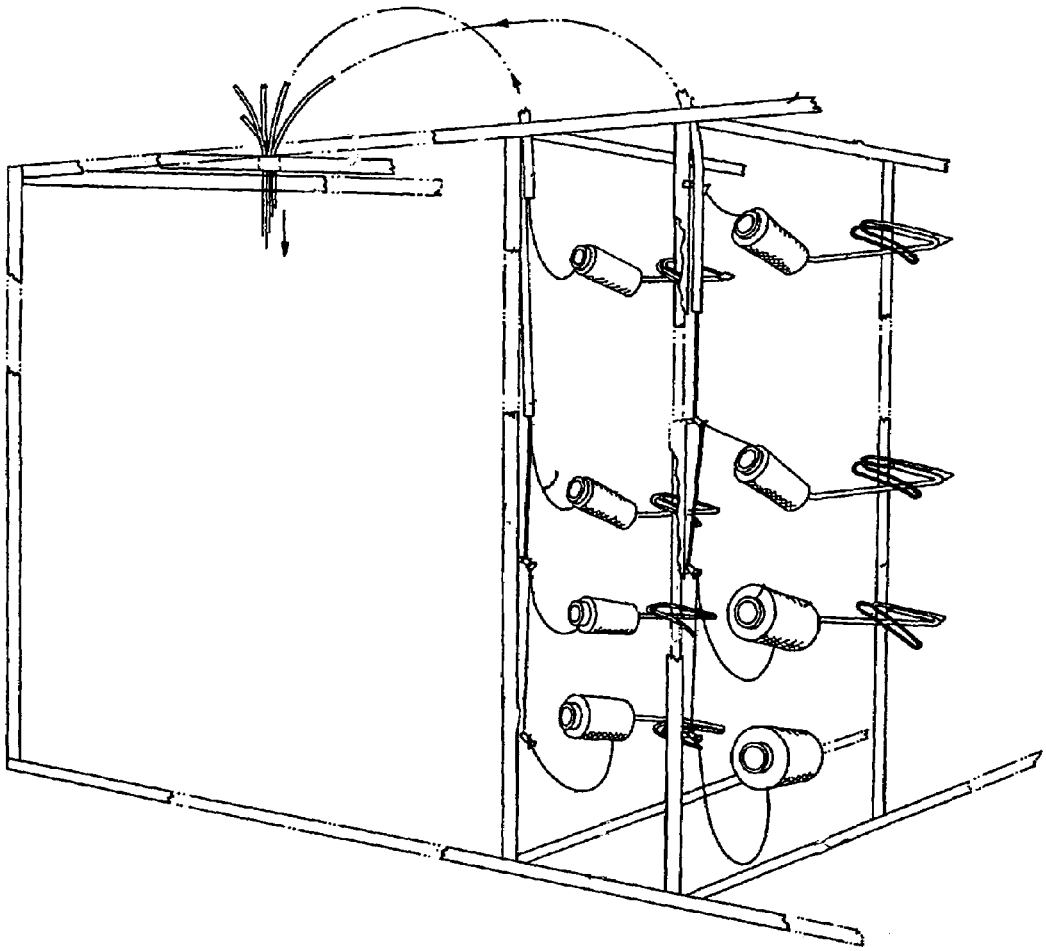
FIG. 1 shows a prior art creel.

FIG. 1 is a prior art creel taken from U.S. Pat. No. 5,531,392. The yarn cones direct yarns into eyelets or into tubes at a creel. The specific yarns which will be directed to a single needle are placed together at the creel.

Figure 2:
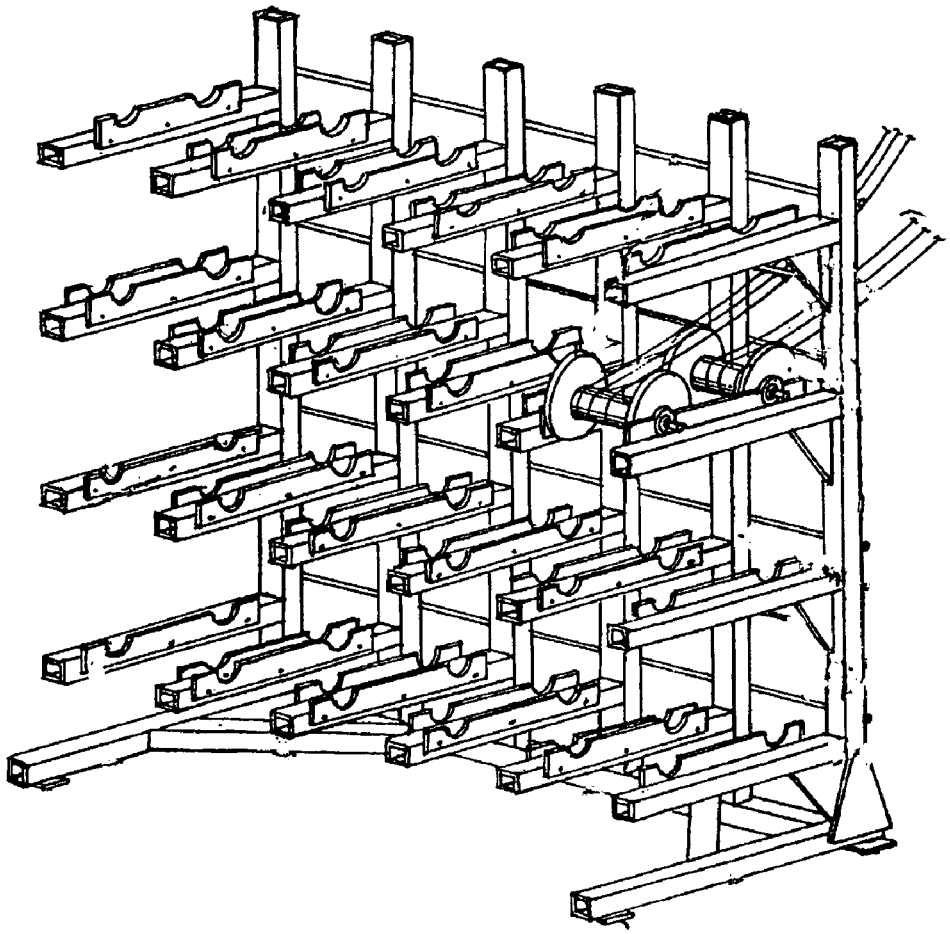
FIG. 2 shows a prior art mini-beam.

FIG. 2 is a prior art beam system taken from U.S. Pat. No. 6,592,069. While each beam has a plurality of yarn ends wrapped thereabout, each yarn end is directed to a separate needle.

Figure 3:
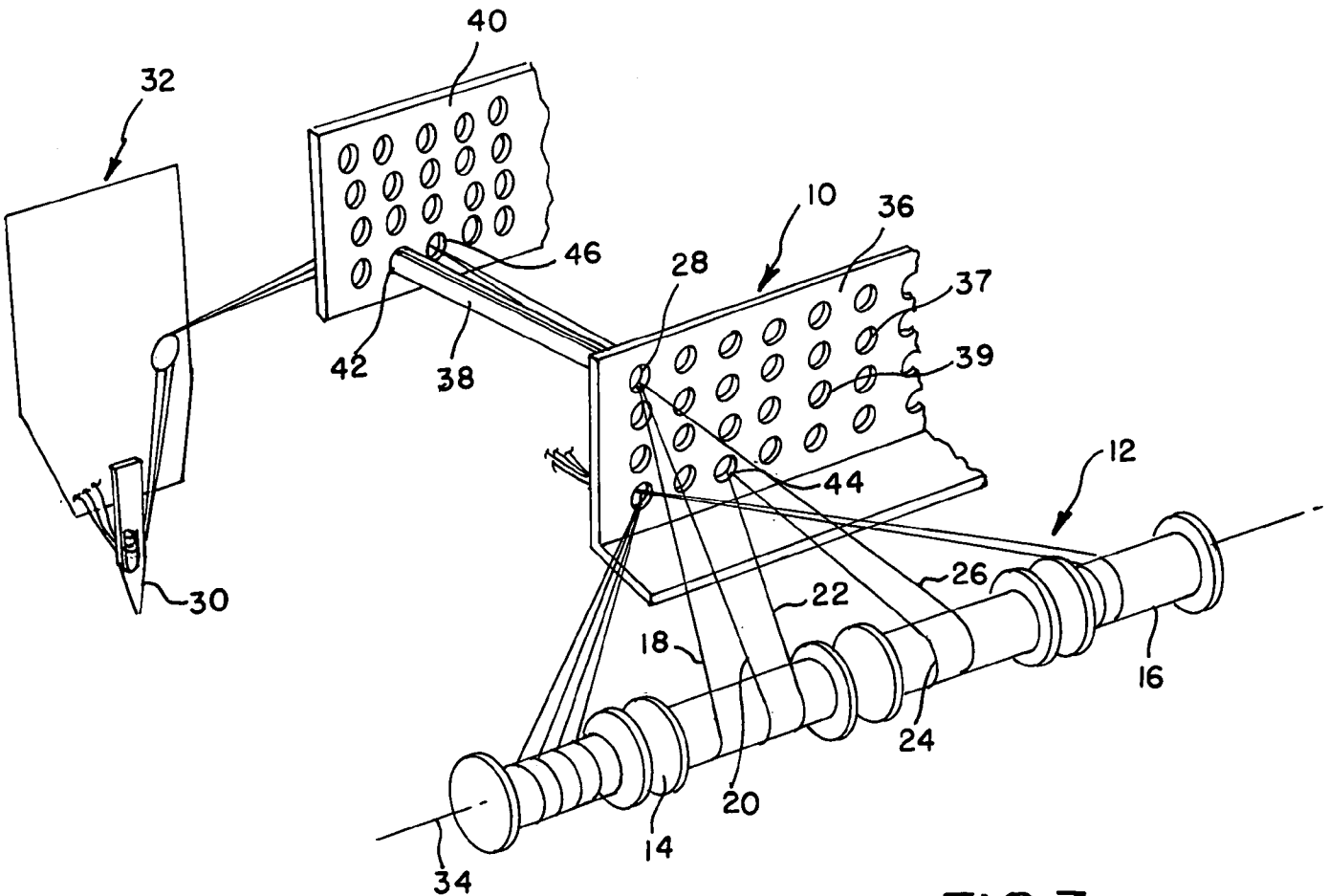
FIG. 3 shows a perspective view of an eye board receiving a plurality of yarn strands at each eye from a yarn supply in the form of a beam, directing the strands through a tube bank and sending each of the yarns to needles which correspond with a particular eye.

FIG. 3 shows the presently preferred embodiment of the present invention having a header 10 connected to a yarn supply 12. The yarn supply 12 is illustrated as having a plurality of beams 14. Each of the beams 14,16 is preferably wound with at least two, and possibly three or more yarn ends 18,20,22 and 24,26. From the yarn supply, the yarn ends 18,20,22 and 24,26 are directed to the header 12 without inserting the yarn ends 18,20,22 directly into guide tubes as is done in with the creel configurations shown in U.S. Pat. Nos. 5,531,392 and 5,613,643.

At the header 12, a plurality of yarn ends such as yarn ends 18,20,26 are inserted into a particular eye 28 of the header 10. The plurality may include 2, 3, 4, 5, 6, or more yarn ends per eye 28. The header 10 is preferably constructed as a planar eye board 36 having a plurality of eyes 28,37,39,40 therethrough. For every needle 30 (only one is shown in tufting machine 32, but it will be understood to one skilled in the art that additional needles would be behind the illustrated needle 30) of the tufting machine which is to receive a yarn end, at least one eye is preferably provided at the header 10.

The eye 28 may receive at least two yarn ends 18,20 from a beam 14 which rotates about an axis 34. Additionally and/or alternatively the eye 28 may receive at least two yarn ends 18,26 (or more yarn ends) from two or more beams 14,16 (at least one from each beam 14 or 16 and any number more). The respective yarn ends are directed from the header 10, or first header, toward the tufting machine 32 either directly, through a tube 38, and/or to a staging header 40, or a second header, before proceeding to a tufting machine 32 and/or pattern attachment which could be integral or separate as it relates to the tufting machine 32. Although only a single tube 38 is illustrated in the drawings, it will be obvious to one skilled in the art that a plurality of tubes could be utilized to direct yarn from any of the eyes 28 of the first header 10 to any of the eyes 42 illustrated on the staging or second header 40. Providing additional tubes in the figure could unnecessarily clutter the figure. Furthermore, although a tufting machine 32 is illustrated other devices might also utilize this multi-strand principle.

When yarn ends are fed as illustrated from a particular beam such as beam 14 to more than one eye, such as eyes 28, 44, it is important that the needles fed by yarns 18,20,22 provide similar stitches so that the unwanted slack does not develop intermediate the header 10 and the yarn supply 12. Accordingly, it is probable that the yarn ends from a single beam will normally be directed to needles which are providing the same stitch (such as in a repeating pattern) at the same time.

When multiple yarns from a single beam, such as beam 14, are provided to a particular eye, such as eye 28, they then can proceed to a particular needle, in this case needle 30. Accordingly each of the yarn ends 18,20 would proceed at the same rate and amount from the beam 14 as a result of the tufting process. In the illustrated embodiment, since yarn strand 22 will be fed at the same rate and amount as ends 18,20, and 26, it makes since that yarn ends 22 and 26 can be fed at the same speed and rate to eye 44 (which will then supply a similar stitch as being provided by needle 30, except through a different needle). Other beams (not shown) could be simultaneously providing a different stitch or the same stitch at the same time with additional yarns.

Although only three yarns are illustrated on beam 14, and only two yarn ends 24,26 on beam 16, it will be understood by one skilled in the art that more, and even many more, yarn ends can be provided on a single beam. Furthermore, although beams 14,16, are illustrated positioned collinearly along the same rotation axis 34, it will be understood by one skilled in the art that the rotation axes 34 of the beams 14,16 need not be collinear. They may be parallel and non-linear, or any other configuration.

In addition to using beams 14,16 with the yarn supply 12, it is also possible to utilize a creel with the method and apparatus of the present invention. Specifically, instead of utilizing the structures and methods as taught in U.S. Pat. Nos. 5,531,392 and 5,613,643, the yarn ends could be fed to the header 10 as shown where the specific yarns, such as yarn ends 18, 20, 26, which would be from separate yarn cones come together at the header 10 instead of in guide tubes as shown in the prior art patents.

Another alternative embodiment would include the ability to provide a header 10 which receives a single yarn end and then directs at least two yarns to a single eye, such as eye 46 of a staging header 40.

The use of beams to provide a plurality of yarn ends to a single needle is believed to be new. Additionally the use of a header to receive a plurality of yarn ends from beams and/or yarn cones independent of combining in guide tubes and then assist in directing the yarn ends to the tufting machine where a plurality of yarns are directed to a single needle is also believed to be new.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of feeding a group of at least two yarn strands to a textile machine having a plurality of needles, said textile machine using said yarn strands from at least a first and a second beam, said first and second beam separately rotatable about corresponding rotation axes, said method comprising directing a first strand of yarn from said first beam toward a first eye in a first header having a plurality of eyes and separately directing a second strand of yarn from one of a first and second beam toward the first eye in the first header, and then beginning to jointly feed said first and second strands of yarn at the first eye in the first header and continuing to jointly feed the first and second strands towards said textile machine to be provided to a single needle of the textile machine with the first and second beams rotating about their respective rotation axes while directing first and second yarns to the first header, and while proceeding from the first eye towards the textile machine, the jointly fed yarns pass jointly through at least one of a tube and a second eye of a second header having a plurality of eyes.

2. The method of claim 1 wherein the first and the second strands of yarn are rotatably fed from the first beam, and said second beam further comprising a third strand of yarn, said third strand of yarn jointly feeding with the first and second strands of yarn at the first eye in the header.

3. The method of claim 1 wherein the second strand is rotatable provided from the first beam and further comprising a third strand rotatably provided from the first beam with the third strand is provided through a second eye in the header.

4. The method of claim 1 wherein the first eye is one of a plurality of eyes in a planar eye board.

5. The method of claim 1 wherein the first and second strands of yarn are directed from the first eye to a second header before proceeding to the textile machine wherein said second header is closer to the textile machine than the first header.

6. The method of claim 5 wherein the first and second strands proceed through a tube from the header to the staging header.

7. The method of claim 6 wherein the tube directs the first and second strands to an eye in the staging header laterally spaced from the first eye.

8. The method of claim 1 further comprising a third yarn strand fed from a third beam to the first eye in the header.

9. A method of feeding a group of at least two yarn strands to a textile machine using said yarn strands from a rotating yarn supply, said method comprising directing a first strand of yarn from said rotating yarn supply toward a first eye of a planar first header having a plurality of eyes and directing a second strand of yarn from the rotating yarn supply toward the first eye of the planar first header, said first and second strands spaced from one another until meeting at the first eye, and then jointly feeding said first and second strands of yarn at the first eye of the planar header and continuing to jointly feed the first and second strands towards said textile machine to a single needle through at least one of a tube and a first eye of a second header having a plurality of eyes therethrough.

10. The method of claim 9 wherein the textile machine is a tufting machine having a plurality of needles and the planar header is located within a plane parallel to the needles and further comprising the step of tufting a backing with the first and second strands of yarn with the tufting machine through the single needle.

11. The method of claim 10 wherein the yarn supply further comprises at least one beam having an axis of rotation and the axis of rotation is perpendicular to the plane containing the planar header and during the step of directing yarn from the yarn supply toward the first eye in the header, the at least one beam rotates about its axis of rotation.

12. The method of claim 11 wherein the at least one beam further comprises a first and a second beam each having an axis of rotation.

13. The method of claim 12 further comprising one of a third, fourth, fifth, and sixth yarn strand fed to the first eye in the header from one of the first and second beams.

14. The method of claim 13 wherein the axes of rotation of the first and second beams are collinear.

15. The method of claim of claim 9 wherein the planar header is an eye board having the plurality of eyes therethrough, and the header is located intermediate the yarn supply and the textile machine.

16. The method of claim 9 wherein the jointly fed yarns from the planar header proceed through a tube to the needle at the tufting machine where the jointly fed yarns are jointly tufted through a backing.

17. The method of claim 9 wherein the jointly fed yarns proceed through a tube to an eye at the staging header before being directed to the needle wherein the eye at the staging header is laterally displaced relative to the first eye.

18. The method of claim 17 wherein the textile machine is a tufting machine, and the jointly fed yarns are directed to a particular needle of the tufting machine.

19. The method of claim 18 wherein the staging header is a planar eye board.

20. The method of claim 17 wherein the staging header is parallel to the planar header.

* * * * *